US005337672A

United States Patent [19]

Boissiere et al.

[11] Patent Number: 5,337,672

[45] Date of Patent: Aug. 16, 1994

[54] LOCKING DEVICE FOR A CASING CONTAINING PYROTECHNIC MATERIALS

[75] Inventors: Bruno Boissiere, Olivet; Michel Bossus, Chevilly, both of France

[73] Assignee: Thomson-Brandt Armements, Saint Aubin, France

[21] Appl. No.: 974,259

[22] Filed: Nov. 10, 1992

[30] Foreign Application Priority Data

Nov. 29, 1991 [FR] France ..... 91 14818

[51] Int. Cl.[5] ..... F42B 39/20; F42B 39/14

[52] U.S. Cl. ..... 102/481; 60/223

[58] Field of Search ..... 102/481, 293, 374; 89/1.812; 60/223, 253, 255

[56] References Cited

U.S. PATENT DOCUMENTS

| | | | |
|---|---|---|---|
| 2,775,201 | 12/1956 | Conway | 102/374 |
| 4,557,198 | 12/1985 | Hickey | 102/481 |
| 4,597,261 | 7/1986 | Dolan | 60/253 |
| 4,646,642 | 3/1987 | Nagler et al. | 102/293 |
| 4,991,513 | 2/1991 | Malamas et al. | 102/481 |
| 5,155,298 | 10/1992 | Koontz | 102/481 |

FOREIGN PATENT DOCUMENTS

| | | |
|---|---|---|
| 0163086 | 12/1985 | European Pat. Off. . |
| 1088607 | 5/1959 | France . |
| 2652644 | 4/1991 | France . |
| 721541 | 1/1955 | United Kingdom . |

*Primary Examiner*—David H. Brown

*Attorney, Agent, or Firm*—Lippe, Goldstein, Wolf Meltzer

[57] ABSTRACT

Ignition means being provided to ignite pyrotechnic materials, this ignition is produced by the activation of these ignition means. As long as the ignition means have not been activated, the casing is maintained firmly attached to a closing plug only by a first set of locking means so that at pressures within the casing in excess of a given pressure, the plug is ejected from the casing. As soon as the ignition means have been activated, the casing is maintained firmly attached to the plug by a second set of locking means at pressures within the casing in excess of the given pressure.

9 Claims, 3 Drawing Sheets

LOCKING DEVICE FOR A CASING CONTAINING PYROTECHNIC MATERIALS

BACKGROUND OF THE INVENTION

The present invention concerns a locking device for a casing containing pyrotechnic materials. It applies for instance to the reduction of the vulnerability of propulsion devices to external aggressions.

Two types of aggression have safety implications for the storage and use of products containing pyrotechnic charges, in particular propellant devices: aggressions due to overheating, and aggressions of a mechanical type.

In aggressions due to slow or rapid overheating, two phases can be distinguished. The first is constituted by the rise in temperature of a propellant device, for example, up to the self-ignition temperature of the pyrotechnic materials, generally propellant grain. The period between the start of the thermal aggression and the pyrotechnic incident depends on the self-ignition temperature of propellant grain and also on the structural parts surrounding the charge such as collars, thermal protections or inhibitors for instance. Generally the invulnerability specifications lay down a minimum period, for example 3 to 5 minutes, for this self-ignition.

The second phase corresponds to the pyrotechnic incident itself. Neither detonation nor deflagration are acceptable, but if combustion can not be totally avoided a pyrotechnic incident of minimal gravity is sought, that is to say a combustion with neither propulsion nor projection. However, the rise in pressure of gases generated by self-ignition of the pyrotechnic charge, for example propellant grain, leads to a explosion of the casing of the propellant device, thus to a deflagration. In a propellant device, this rise in pressure is indeed very difficult to avoid for the casing of the latter is designed to withstand a very high internal pressure, generally the maximum functioning pressure plus a safety margin, which may be several hundred bars.

In the case of mechanical types of aggression, for instance impacts of bullets or fragments, it is not possible to rely on a local deformation, a penetration for instance, caused by the mechanical aggression, in order to avoid a rise of pressure of the casing if a pyrotechnic incident takes place. Propellant and pyrotechnic products must therefore be chosen which do not detonate easily under impact and the system designed so that any pyrotechnic incident caused by an impact results in neither deflagration nor propulsion.

In order to avoid the incidents mentioned above, so-called "active" protection processes are known to professionals. These processes consist in completely opening up the casing as soon as an accidental incident is discovered. They have the inconvenience of requiring further components such as captors, sources of energy or activators for instance, which significantly increase the complexity of the system. Moreover, their operation must be assured in all accidental environments.

SUMMARY OF THE INVENTION

The aim of the invention is to overcome the above-mentioned drawbacks by providing in particular for a double locking system depending on the internal pressure of the casing.

The purpose of the invention is therefore to propose a locking device for a casing containing pyrotechnic materials and ignition means which can be activated to ignite said pyrotechnic materials, the ignition means comprising at least one charge contained in a chamber the combustion of which increases the pressure inside this chamber, the casing having an opening closed by a plug, characterized by the fact that it comprises a first locking means assuring the attachment of the plug to the casing up to a given threshold of internal pressure Po and a second locking means assuring the attachment of the plug to the casing when the ignition means are activated after which pressures within the casing exceed the given threshold Po.

The main advantages of the invention are that it enables a normal ignition to be distinguished from an accidental one, that it enables the confinement of the casing of the propellant device to be maintained only in the case of normal ignition, thus providing efficient protection against deflagration notably during phases such as the storage, handling or transport for instance, and that it is simple to use and relatively cheap.

BRIEF DESCRIPTION OF THE DRAWING

Other characteristics and advantages of the invention will appear with the help of the description that follows, which make reference to the annexed drawings which represent.

FIGS. *2a*, *2b*, *3a* and *3b*: possible embodiments of devices according to the invention.

DESCRIPTION OF THE INVENTION

Figure 1:
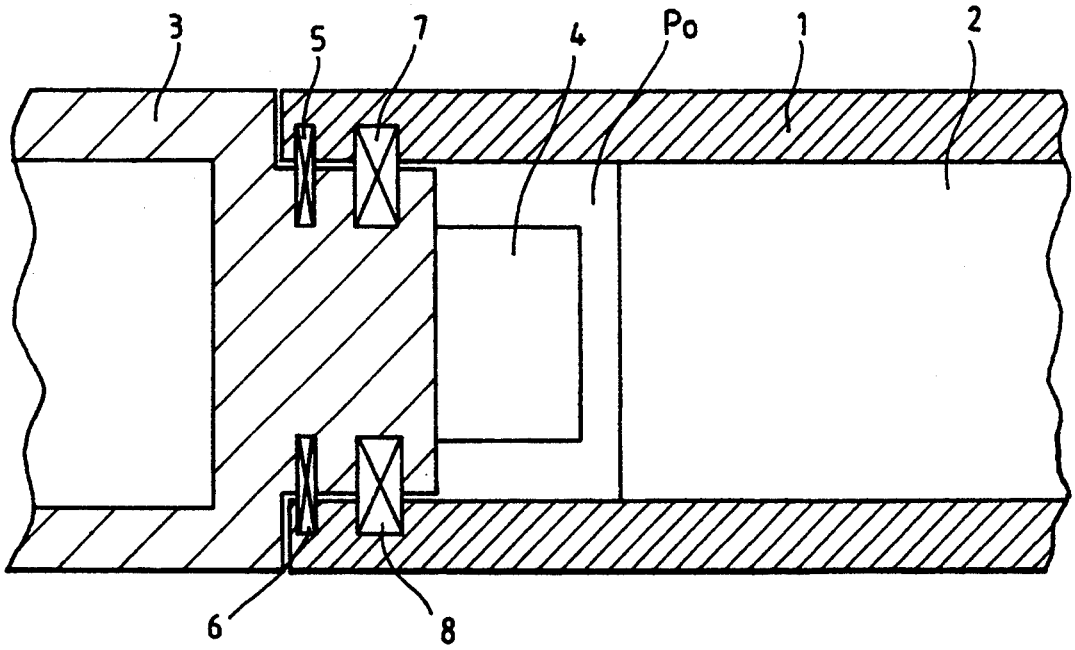
FIG. 1: a cross-sectional view of a device according to the invention.

FIG. 1 presents a cross-sectional view of casing 1 containing pyrotechnic materials 2 the open end of which is closed by a plug 3. The pyrotechnic materials 2 may be those of a propellant device, constituted for example by a block of propellant, and the plug, the end of a rocket for instance. Ignition means 4 firmly attached for example to plug 3 are capable of initiating pyrotechnic materials 2. This initiation is produced by the activation of ignition means 4, this activation being controlled for example by an electric signal. Once ignited the pyrotechnic materials 2 generate hot gas, at a temperature generally of about 2000° C.

In FIG. 1, according to the invention, casing 1 is maintained firmly attached to plug 3 by at least a first set of locking means 5, 6. These means 5, 6 may be screws, for example. If the pressure within the casing exceeds a given pressure Po, locking means 5, 6 no longer ensure the attachment of casing 1 to plug 3. They shear, for example, enabling the casing to be opened in the event of accidental internal over-pressure.

The locking device comprises a second set of locking means 7, 8 according to the invention. When these are active, they assure the attachment of casing 1 to plug 3. According to the invention, they maintain casing 1 firmly attached to plug 3 only if ignition means 4 have been activated. Furthermore, this second set of locking means 7, 8 enables casing 1 to remain firmly attached to plug 3 even when pressures inside the latter exceed given pressure Po, so as to withstand the over-pressures generated by the combustion of pyrotechnic materials 2. This second set of locking means 7, 8 may for example be constituted by pistons attached to plug 3 which enter into notches in casing 1 at the instant of activation of ignition means 4. This second set of locking means must have dimensions enabling them to withstand the pressures inside casing 1, which may for example attain several hundred bars. According to the invention, the first set of locking means 5, 6 may remain active when the second set of means 7, 8 are active, although their supporting role is negligible in view of the strength of the second set of locking means 7,8.

Figure 2B:
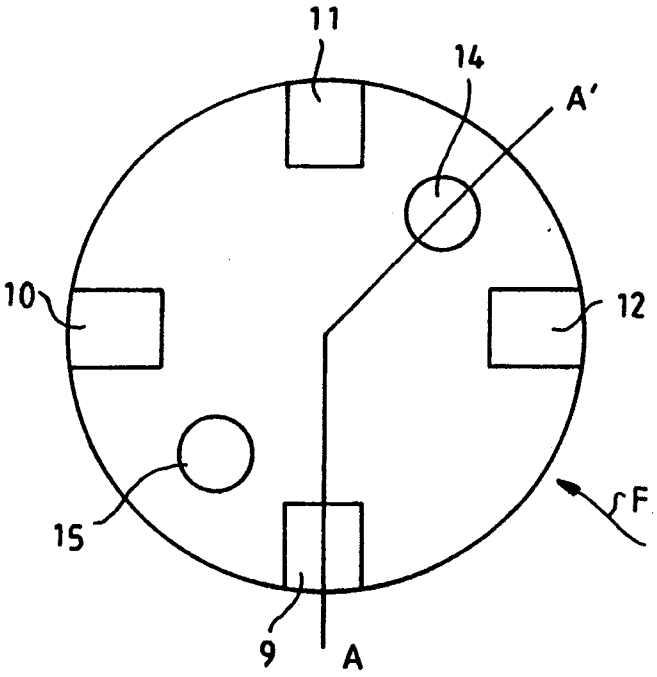
Figure 2A:
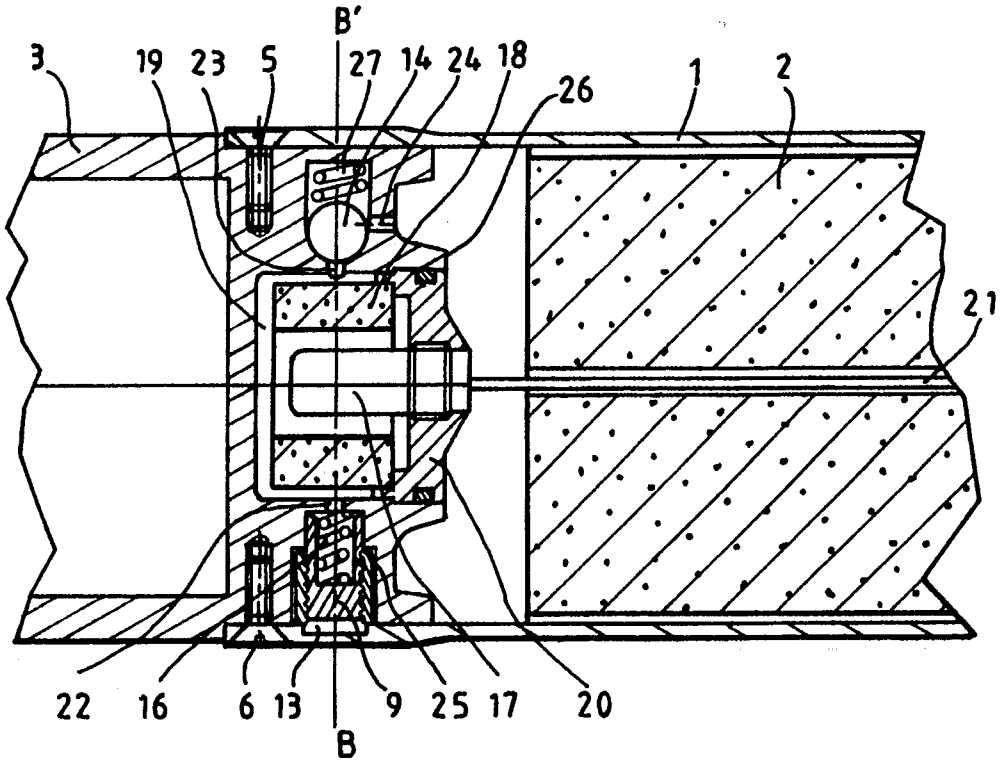

FIG. 2*a* shows details of the possible embodiment of a device according to the invention. This device is used to close the opening of casing 1 using a plug 3 and to lock this plug in place. Plug 3 for example may be the end of a rocket or of a missile, casing 1 holding pyrotechnic materials 2, for example a block of propellant whose combustion provides the propulsion of the rocket or missile. The first set of locking means are for example constituted by screws, three for instance, two of which 5, 6 are shown, which maintain casing 1 attached to plug 3. For this, the screws penetrate through the holes made at the end of casing 1 in contact with plug 3, screws 5, 6 being screwed into tapped holes in this plug 3.

The second set of locking means is constituted for example by four pistons 9–12 only one of which is shown in cross section in FIG. 2*a*, two sealing components 14, 15 only one of which is shown in cross section in FIG. 2*a*, springs holding the pistons and the sealing components two of which 16, 27 are shown in cross section in FIG. 2*a*, these components being firmly attached to plug 3. This second set of locking means is moreover completed by groove 13 made in casing 1 and designed to receive the pistons. Groove 13, receiving piston 9, is shown in FIG. 2*a*. Sealing components 14, 15 may be balls, for example.

FIG. 2*b* represents a cross-sectional view along axis BB′ of FIG. 2*a*, the casing and plug having for example rotational symmetry. This view only shows the position of the four pistons 9, 10, 11, 12 and of the two balls 14, 15 of the device as well as the position of axis AA′ in the cross section of FIG. 2*a*, FIG. 2*a* itself being a cross-sectional view along axis AA′ as represented in FIG. 2*b* and seen in the direction of arrow F. The functioning of the second set of locking means is controlled by the ignition means generally constituted by heating element 17, an electric squib for instance, and by a small charge 18 of rapid combustion situated in chamber 19 inside plug 3 and hermetically closed by bulkhead 20. This bulkhead allows for the end of heating element 17 to protrude from chamber 19 in order to link the latter for example with an electric connection 21.

According to the invention, during the normal functioning of a rocket or missile propellant device in particular, an electric activation signal is transmitted to heating element 17 via electric connection 21. Heating element 17 emits hot gases and ignites charge 18 which burns very rapidly. The pressure generated by its combustion causes the shearing of flanges 25 attached to pistons 9 in grooves 13, the gases passing via conduits 22 linking pistons 9 to chamber 19. Flanges 25 prevent the pistons from occupying grooves 13 under the action of the springs as long as the combustion of small charge 18 has not taken place, i.e. before the normal functioning of the propellant device. During the movement of pistons 9, the pressure continues to increase in chamber 19 until the balls 14, 15 move to allow the passage of gases via conduits 23, 24 thereby igniting the charge of propellant device 2, thanks to their high temperature, 2000° C. for instance. Conduit 23 is linked to chamber 19 and conduit 24 is linked to the charge of propellant device 2, ball 14 closing up the passage between these two conduits as long as it is not moved by the gas generated in chamber 19. The sealing position of the ball is maintained by spring 27. In fact, according to the invention, as long as a part at least of pistons 9 has not entered grooves 13, the ball does not move and seals the passage. This is achieved for example such that at a given value of pressure in chamber 19, the pistons enter partially into grooves 13 and that the force exerted on balls 14, 15 by the pressure is less than that exerted on balls 14, 15 by springs 27. Pistons 9 are maintained in grooves 13 by springs 16 in order to lock the maintaining of casing 1 over plug 3. According to the force exerted by retaining springs 27 on balls 14, 15, it is possible to regulate the pressure inside chamber 19 at which balls 14, 15 are displaced.

If an accidental ignition of charge 2 of the propellant device occurs, the pressure increases within casing 1 but since balls 14, 15 close conduits 23 linking with chamber 19, itself linked to the piston by link conduit 22, the pistons cannot penetrate the grooves 13 in casing 1. In this case, only the first set of locking means 5, 6 attach casing 1 to plug 3. Thus, pressure being exerted on the end 26 of plug 3, the screws constituting for example the first set of locking means, are sheared. The end of the rocket or missile, constituting for example plug 3, becomes separated from casing 1 and therefore from propellant device 2 so that the gases are free to evacuate from the open end of the casing. There is combustion without propulsion, thereby removing any risk of a dangerous incident. Screws 5, 6 must withstand normal forces experienced during ground transport or underwing air transport for example. In the example of the embodiment of the device according to the invention of FIGS. 2*a* and 2*b*, the device comprises among other components four pistons, two balls and three screws, but it is clear that these quantities may vary according to the applications and to the size of the components in particular.

Figure 3B:
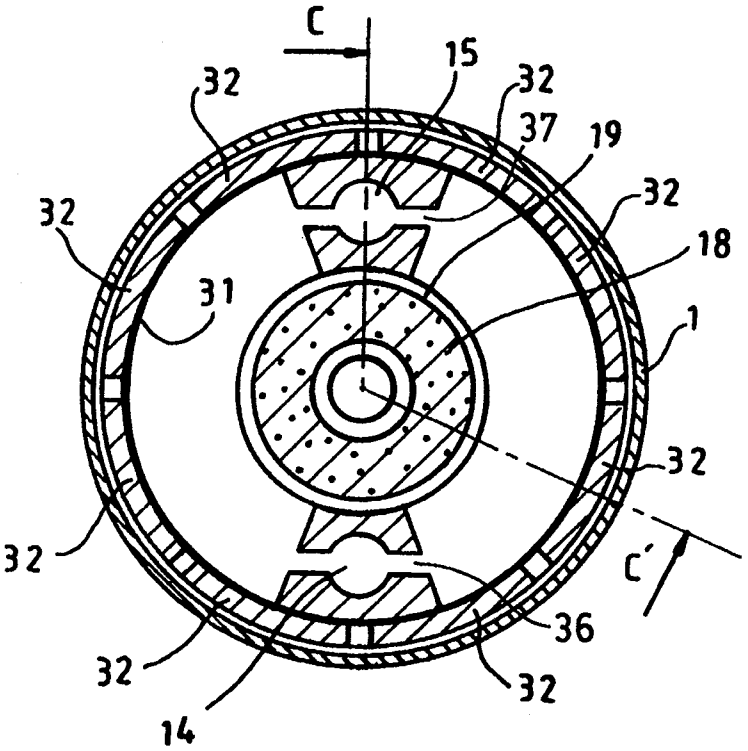
Figure 3A:
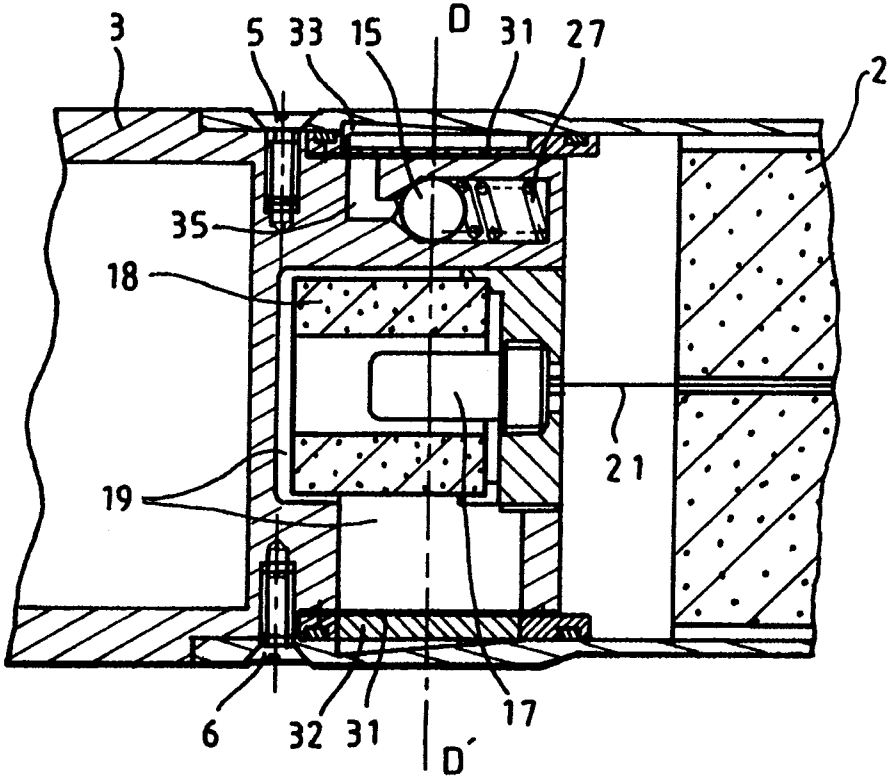

FIGS. 3*a* and 3*b* represent another embodiment of the device according to the invention. The difference from the previous embodiments is that there are no longer any pistons. FIG. 3*b* is a cross-sectional view of FIG. 3*a* along axis DD′ and FIG. 3*a* is a cross-sectional view along axis CC′ of FIG. 3*b*. Ignition means 17, 18, 19 are constituted in the same way as in the embodiment example of FIG. 2*a*. Balls 14, 15 and retaining springs 27 of the latter are placed differently. In the example of FIGS. 3*a* and 3*b*, at the time of the normal functioning of the propellant device, the pressure generated by the combustion of small charge 18 leads to the expansion of thin tube 31 situated between casing 1 and that part of plug 3 entering into this casing and containing ignition means 17, 18, 19. This expansion fragments collar 32 into 8 pieces for instance. This collar is placed between tube 31 and casing 1. These pieces are pressed into groove 33 in casing 1, and thus make the separation of casing 1 from plug 3 impossible since the thin tube 31 suffers permanent deformation. Thin tube 31 having expanded, the gas leaving chamber 19 is able to lift balls 14, 15 via conduit 35 and thereby to ignite the main charge 2 via conduits 36,37. When balls 14, 15 are not lifted by the gases, the passage is closed by these between conduits 35 upon contact with chamber 19 after expansion of thin tube 31 and the conduits 36,37 linked to main charge 2 of a propellant device for example. In this second example of the embodiment presented in FIGS. 3*a* and 3*b*, the second set of locking means are thus constituted by balls 14, 15, their retaining springs 27, thin tube 31, fragmentable collar 32, groove 33, and the fragments of collar 32. The first set of locking means are still for example constituted by screws 5, 6.

In case of accidental ignition of main charge 2 constituted for example by pyrotechnic materials contained in casing 1, the functioning is identical to the previous example described by FIGS. 3*a* and 3*b*.

What is claimed is:

1. Locking device for a casing containing pyrotechnic materials and ignition means which can be activated to ignite said pyrotechnic materials, the ignition means comprising at least one charge contained in a chamber the combustion of which increases the pressure inside this chamber, the casing having an opening closed by a plug, comprising at least:

one sealing component, loaded by a spring so as to block a passage of gas between the chamber and the pyrotechnic materials, and locking means permanently deformed under the action of an initial pressure so as to ensure that the plug is firmly attached to the casing, the combustion of the charge in the chamber creating an increase in pressure so that in a first phase the locking means are deformed when the pressure exceeds the given initial pressure and, in a second phase, the sealing component liberates the passage of hot gas between the chamber and the pyrotechnic materials when the pressure of the chamber becomes higher than a second given pressure, this pressure exerting on the sealing component a force that is greater than and opposed to the force of the spring, the pyrotechnic materials then being ignited by the hot gas.

2. Device according to claim 1, comprising in addition other locking means ensuring that the casing is firmly attached to the plug up to a pressure threshold in the casing that is less than the second given pressure.

3. Device according to claim 1, the ignition means comprising a heating element activated by an electric signal, the activation of the heating element causing the combustion of the charge in the chamber.

4. Device according to claim 1, the sealing component being a ball.

5. Device according to claim 1, the locking means comprising at least a thin tube and a collar, which can be fragmented into sections, located between the thin tube and the casing, the sections of the collar entering into a groove of the casing when the thin tube expands under the action of the pressure of the chamber, the expansion occurring when the pressure becomes higher than the first given pressure, the sections being maintained in the grooves by the permanent deformation of the thin tube.

6. Device according to claim 1, the locking means comprising a piston attached to the plug and engaging a groove in the casing when the pressure of the chamber becomes higher than the first given pressure, the piston being maintained in the groove by a spring.

7. Device according to claim 6, a flange attached to the piston and holding the latter out of the groove being sheared when the pressure of the chamber becomes higher than the first given pressure.

8. Device according to claim 1, the a second locking means being constituted at least by screws penetrating the casing and passing into the plug.

9. Device according to claim 8, the screws comprises a material which shears pressure inside the casing exceeds the pressure threshold.

* * * * *